United States Patent [19]

Darlington et al.

[11] Patent Number: 4,680,101

[45] Date of Patent: Jul. 14, 1987

[54] ELECTROLYTE PERMEABLE DIAPHRAGM INCLUDING A POLYMERIC METAL OXIDE

[75] Inventors: W. Bruce Darlington, Wadsworth; Donald W. DuBois, Akron, both of Ohio

[73] Assignee: PPG Industries, Inc., Pittsburgh, Pa.

[21] Appl. No.: 926,688

[22] Filed: Nov. 4, 1986

[51] Int. Cl.[4] ..... C25B 13/00

[52] U.S. Cl. ..... 204/295; 204/296; 521/53; 521/55; 427/243; 428/271; 428/421; 428/422; 428/443

[58] Field of Search ..... 204/295, 296; 521/53, 521/55; 428/271, 421, 422, 443; 427/243

[56] References Cited

U.S. PATENT DOCUMENTS

| | | | |
|---|---|---|---|
| 4,111,866 | 9/1978 | Torikai et al. | 521/53 |
| 4,238,803 | 12/1980 | Fang | 204/128 |
| 4,272,588 | 6/1981 | Yoldas et al. | 428/433 |
| 4,278,632 | 7/1981 | Yoldas et al. | 264/66 |
| 4,286,024 | 8/1981 | Yoldas et al. | 428/446 |
| 4,346,131 | 8/1982 | Yoldas et al. | 428/35 |

*Primary Examiner*—R. L. Andrews
*Attorney, Agent, or Firm*—Bruce H. Cottrell

[57] ABSTRACT

A polymeric metal oxide such as polytitanic acid, polyzirconic acid or polysilicic acid is incorporated into a liquid permeable diaphragm formed of, e.g., asbestos, asbestos and a polymer resin, polytetrafluoroethylene, or a major amount polyfluorocarbon fibrils and a minor amount perfluorinated ion exchange material. Optionally, the diaphragm may also include inorganic materials such as zirconium oxide, titanium dioxide, aluminum oxide, talc, barium sulfate or potassium titanate, and hydrous inorganic gels such as magnesium oxide gel, zirconium oxide gel, titanium oxide gel or zirconyl phosphate gel.

13 Claims, No Drawings

ELECTROLYTE PERMEABLE DIAPHRAGM INCLUDING A POLYMERIC METAL OXIDE

FIELD OF THE INVENTION

The present invention relates to diaphragms useful for the electrolysis of salt solutions, e.g., in the electrolysis of aqueous alkali metal halide solutions such as sodium chloride brine.

BACKGROUND OF THE INVENTION

Commonly, alkali metal halide brines, such as sodium chloride brines and potassium chloride brines, are electrolyzed in an electrolytic cell wherein a liquid permeable diaphragm divides the cell into an anolyte compartment with an anode therein and a catholyte compartment with a cathode therein to produce chlorine, hydrogen, and aqueous alkali metal hydroxide. Asbestos has been the most common diaphragm material, but has suffered from relatively short lifetimes and from environmental concerns. Numerous efforts have been made to improve the lifetimes and performances of asbestos diaphragms. For example, according to U.S. Pat. No. 3,991,251, asbestos diaphragms can be strengthened by the reaction between asbestos and sodium hydroxide at temperatures from about 110° C. to 280° C. Other patents describe strengthening asbestos diaphragms by addition of polymeric resins, e.g., fluorine-containing polymers, to bind the asbestos diaphragms. See U.S. Pat. Nos. 4,065,534; 4,070,257; 4,142,951; and 4,410,411.

Asbestos-free microporous diaphragms have been produced by sintering materials such as polytetrafluoroethylene (PTFE) and a particulate pore forming additive followed by subsequent removal of the additive, as shown by for example U.S. Pat. Nos. 3,930,979, 4,098,672 and 4,250,002. U.S. Pat. No. 4,036,729 describes depositing discrete thermoplastic fibers of, e.g., a fluorinated hydrocarbon, from an aqueous medium containing acetone and preferably a fluorocarbon surfactant onto a cathode screen for use as a diaphragm in electrolytic cells. The deposited fibers form an entanglement or network which does not require bonding or cementing. Unfortunately, such polyfluorocarbon diaphragms generally are hydrophobic, i.e., difficult to wet with water. This hinders passage of an aqueous electrolyte through the diaphragm, and results in high cell voltages, particularly in comparison to asbestos-based diaphragms under similar cell conditions.

U.S. Pat. No. 4,482,441 describes codeposition of fibrils of a hydrophobic organic polymer, e.g., a copolymer of tetrafluoroethylene and perfluoropropylene, and a hydrophilic group IIA metallic oxide, e.g., magnesium oxide particles, from an alkaline brine containing sodium hydroxide, sodium chloride and a polyethyleneimine-based retention agent onto the cathode of a cell. Such a deposited diaphragm may also include a surface active agent, e.g., a fluorinated surface active agent.

Finally, U.S. Pat. No. 4,606,805 describes a diaphragm containing as its principal particulate ingredient an inorganic material such as talc, a metal silicate, an alkali metal titanate, an alkali metal zirconate or a magnesium aluminate, along with both polytetrafluoroethylene fibers and polytetrafluoroethylene particulates.

Clearly, further developments are constantly sought whereby diaphragms may achieve improved performance in terms of cell voltages while exhibiting excellent wettability by aqueous electrolytes.

SUMMARY OF THE INVENTION

The invention herein contemplated provides a liquid permeable diaphragm for an electrolytic cell, the diaphragm including a polymeric metal oxide exemplified by polytitanic acid, polyaluminic acid, polysilicic acid, and polyzirconic acid. The polymeric metal oxide material is incorporated into the diaphragm by applying a solution including an alcohol, water, and a hydrolyzed metal alkoxide, the metal being selected from aluminum, titanium, zirconium or silicon, to a deposited or preformed diaphragm, and then heating the diaphragm including the applied solution at temperatures of from about 90° C. to 150° C. to cure the polymeric metal oxide material. In one embodiment, the diaphragm includes a major amount of fibrillated polyfluorocarbon, e.g., polytetrafluoroethylene, a minor amount of a perfluorinated ion exchange material and a polymeric metal oxide selected from the group of polyaluminic acid, polytitanic acid, polyzirconic acid, polysilicic acid or mixtures thereof. For example, the diaphragm may include from about 65 to 99 percent by weight fibrillated polyfluorocarbon and from about 1 to about 35 percent by weight perfluorinated ion exchange material, basis total weight of polyfluorocarbon and perfluorinated ion exchange material. Preferably, the polyfluorocarbon is polytetrafluoroethylene and the perfluorinated ion exchange material is a perfluorinated organic polymer containing ion exchange functional groups selected from the group consisting of carboxylic acid (—COOH), sulfonic acid (—$SO_3H$) or an alkali metal salt of carboxylic acid or sulfonic acid. Such perfluorinated ion exchange material can be present in the form of particulates usually dispersed throughout the diaphragm or as a film coating the fibrillated polyfluorocarbon.

Such a diaphragm of fibrillated polyfluorocarbon and perfluorinated ion exchange material may also include a minor amount of inorganic particulates chemically resistant to the intended cell environment, such particulates exemplified by titanium dioxide, zirconium oxide, potassium titanate, silicon carbide, aluminum oxide, talc, barium sulfate, asbestos, and mixtures thereof.

In another embodiment, the diaphragm consists essentially of fibrillated polyfluorocarbon, e.g., polytetrafluoroethylene, and the polymeric metal oxide as previously described.

In still another embodiment the polymeric metal oxide is included within a liquid permeable diaphragm such as an asbestos diaphragm or an asbestos diaphragm including a polymeric resin.

DETAILED DESCRIPTION OF THE INVENTION

In the present invention, a polymeric metal oxide wherein the metal is selected from among titanium, zirconium, silicon, and aluminum or combinations thereof can be incorporated into a pre-formed diaphragm of, e.g., asbestos, asbestos in combination with a polymeric resin, fibrillated polyfluorocarbon such as polytetrafluoroethylene, or such fibrillated polyfluorocarbon with perfluorinated ion exchange material. Such polymeric metal oxides are exemplified by polytitanic acid, polyzirconic acid, polysilicic acid and polyaluminic acid. For example, the polymeric metal oxide can be added to a pre-formed diaphragm of fibrillated polyfluorocarbon and perfluorinated ion exchange material as a clear solution of a partially hydrolyzed metal alkoxide which prior to hydrolyzation is represented by the formula $M(OR)_4$ wherein M is titanium, zirconium, silicon, or aluminum, R is an alkyl with from 1 to 6 carbon atoms and the solution solvent is an organic solvent for any metallic or metalloid alkoxide present in the solution. The organic solvent can be an alcohol such as propanol or ethanol. The clear solution also contains hydrolyzing water which is generally present in an amount from about 1 mole to about 4 moles per mole of metal alkoxide. In addition the solution may include a few drops of a mineral acid, such as nitric acid, as a catalyst. Such a clear solution may be allowed to age for up to several hours to provide time for completion of hydrolyzation whereupon polymerization and cross linking of the metal oxide can occur. The polymeric metal oxide is distributed throughout the diaphragm, e.g., by brushing or spraying the clear solution onto the diaphragm or by dipping the diaphragm into the clear solution to saturate the diaphragm. Thereafter, the diaphragm is heated at temperatures from about 100° C. to 150° C. for sufficient time, generally about 1 to 2 hours, to dry and cure the polymeric metal oxide. The diaphragm may then be operated in an electrolytic cell.

In similar manner, the polymeric metal oxide may be combined with a diaphragm of fibrillated polyfluorocarbon, e.g., Polytetrafluoroethylene, in the absence of the perfluorinated ion exchange material. The polymeric metal oxide may provide such a diaphragm with the desired wettability usually provided by the perfluorinated ion exchange material. Generally, the polymeric metal oxide will be present in an amount of from about 1 to about 10 percent by weight, basis total weight of diaphragm.

The polymeric metal oxide may also be added to a diaphragm formed of asbestos or asbestos in combination with a polymeric resin. Such asbestos and asbestos-polymeric resin diaphragms can be formed by deposition of the asbestos and optionally the polymeric resin from, e.g., an aqueous slurry including sodium hydroxide, followed by heat-treating the diaphragm to react the asbestos and sodium hydroxide. Such a heat treatment may be at temperatures whereat the polymeric resin does not undergo melting or sintering or optionally the resin may be melted or sintering. The polymeric resin can be chosen from those described in U.S. Pat. No. 4,186,065 at columns 6 and 7 and such description is hereby incorporated by reference. Other methods of preparing asbestos or asbestos and polymeric resin diaphragms are well known to those skilled in the art.

The diaphragm separators of this invention are liquid permeable, thus allowing an electrolyte subjected to a pressure gradient to pass through the diaphragm. Typically, the pressure gradient in a diaphragm cell is the result of a hydrostatic head on the anolyte side of the cell, that is, the liquid level in the anolyte compartment will be on the order of from about 1 to about 25 inches higher than the liquid level of the catholyte, although higher or lower levels are permissible and restricted only by space or electrolytic cell hardware limitations. The specific flow rate of electrolyte through the diaphragm can vary with the type and use of the cell. In a chlor-alkali cell, the diaphragm should be able to pass about 0.001 to about 0.5 cubic centimeters of anolyte per minute per square centimeter of diaphragm surface area. The flow rate is generally set at a rate that allows a predetermined, targeted product concentration, e.g., sodium hydroxide concentration, and the level differential between the anolyte and catholyte compartments is then related to the porosity of the diaphragm and the tortuosity of the pores. For use in a chlor-alkali cell the diaphragm will preferably have a permeability similar to that of asbestos-type diaphragms so that electrolytic cell equipment in operation with asbestos-type diaphragms can be utilized.

A pre-formed diaphragm of the present invention can be prepared by depositing the diaphragm material from a slurry onto a liquid permeable substrate, e.g., a foraminous cathode. The foraminous cathode is electroconductive and may be a perforated sheet, a perforated plate, metal mesh, expanded metal mesh, metal rods, or the like. For example, the openings in foraminous cathodes commercially used today in chlor-alkali cells are usually about 0.05 to about 0.125 inches in diameter. Most commonly the cathode will be of iron or an iron alloy. By iron alloy is meant a carbon steel or other alloy of iron. Alternatively, the cathode can be nickel or other cell environment resistant electroconductive material. Cathodes suitably used in this invention include those having an activated surface coating, for example, those cathodes with a porous Raney nickel surface coating. Raney nickel coatings can provide a reduction of hydrogen overvoltage at the cathode and allow a savings in energy consumption and cost in the electrolysis of brine. Raney nickel coatings can be provided by various expedients well known to those skilled in the art.

Such diaphragms are generally deposited upon the foraminous cathode in an amount of about 0.1 to about 0.5 pounds per square foot diaphragm material more preferably about 0.25 to 0.35 pounds per square foot diaphragm material, e.g., asbestos, polyfluorocarbon fibrils, perfluorinated ion exchange material, etc. The diaphragm will generally have a thickness of about 0.01 to 0.25 inches, preferably about 0.02 to 0.15 inches to achieve best results in terms of voltage and energy efficiency.

The pre-formed diaphragm of this invention can include fibrillated polyfluorocarbon and optionally perfluorinated ion exchange material wherein such diaphragm is prepared by depositing any perfluorinated ion exchange material in the form of discrete particulates or as a solution, and polyfluorocarbon fibrils from a slurry onto a cathode, e.g., onto a cathode with a non-planar configuration. For example, polyfluorocarbon fibrils and discrete perfluorinated ion exchange material particulates can be dispersed within the liquid slurry without rapid settling with surfactants and viscosity modifiers added to aid in the dispersion. Following deposition, a fibrillated polyfluorocarbon mat having a highly branched structure, which branched structure provides support for the diaphragm through entanglement of the fibrils, is formed. The polyfluorocarbon fibrils can be drawn against the cathode under the pressure of a vacuum to provide packing of the diaphragm material.

Inclusion of perfluorinated ion exchange material with the polyfluorocarbon fibrils can provide the diaphragm with wettability, i.e., an aqueous brine can pass through the diaphragm without the necessity of first passing a liquid such as an alcohol through the diaphragm. Also, such a diaphragm will not tend to accumulate gas bubbles and thus may maintain low steady voltages. Perfluorinated ion exchange material may serve additionally as a glue or binder for the fibrils. Generally, such a diaphragm will contain a major amount of the polyfluorocarbon fibrils, i.e., greater than 50 percent by weight of the fibrils. As perfluorinated ion exchange material is generally more costly than polyfluorocarbon fibrils, the diaphragm more preferably includes from about 65 to about 99 percent by weight polyfluorocarbon fibrils and from about 1 to about 35 percent by weight perfluorinated ion exchange material. Within such percentage ranges, the larger percentages of polyfluorocarbon fibrils are most preferred to minimize diaphragm cost, i.e., the diaphragm includes from about 95 to about 99 percent by weight polyfluorocarbon fibrils and from about 1 to about 5 percent perfluorinated ion exchange material wherein the perfluorinated ion exchange material provides the diaphragm with wettability.

Fibrillated polyfluorocarbon materials useful in this invention include, for example, polyvinylfluoride, polyvinylidene fluoride, polyperfluoro(ethylene-propylene), polytrifluoroethylene, poly(chlorotrifluoroethylene-ethylene), poly(tetrafluoroethylene-ethylene), polychlorotrifluoroethylene, and polytetrafluoroethylene. Preferably, the polyfluorocarbon is polytetrafluoroethylene (PTFE).

Perfluorinated ion exchange material may be incorporated in a diaphragm of this invention in the form of, e.g., a solid, a gel or a solution. As a solid, for example, the perfluorinated ion exchange material can be added to the slurry as discrete particulates or fibers. As a solution, perfluorinated ion exchange material can be added to the slurry dissolved in any suitable solvent such as ethanol although rather than being dissolved the perfluorinated ion exchange method may be highly solvated particles. The solid perfluorinated ion exchange material may be, e.g., in the acid form of the perfluorinated ion exchange material and may be swollen with an organic liquid such as ethanol or isopropanol.

Such perfluorinated ion exchange material is generally an organic copolymer formed from polymerization of a fluorovinylether monomer containing a functional group, i.e., an ion exchange group or a functional group easily converted into an exchange group, and a monomer chosen from the group of fluorovinyl compounds, e.g., vinyl fluoride, vinylidene fluoride, trifluoroethylene, tetrafluoroethylene, hexafluoropropylene, chlorotrifluoroethylene, and perfluoro(alkylvinylether) with the alkyl being a $C_1$–$C_{10}$ alkyl group. The functional groups are —COOM or —$SO_3M$ or may be —PO(OM)$_2$ or —OPO(OM)$_2$ where M is hydrogen or an alkali metal ion. Further, the functional groups may be precursors of the —COOM or —$SO_3M$ groups which can be converted to the carboxylic acid or sulfonic acid and salts thereof by hydrolysis.

The content of the fluorovinylether having the functional groups in the copolymer is important as it determines the ion exchange potential of the perfluorinated ion exchange material and thus, controls its hydrophilicity or wettability. The fluorovinyl ether content is generally in the range of about 1 to about 50 mole percent, preferably about 2 to about 40 mole percent. Generally, the equivalent weight of the perfluorinated ion exchange material will be from about 600 to 2000. Equivalent weight is the weight of material in grams which contains one equivalent of potential ion exchange capacity.

The perfluorinated ion exchange material can generally be from those materials presently supplied for use as electrolyte impermeable membranes in various electrolytic cells, in particular, the membrane materials known as Nafion ®, available from E. I. DuPont de Nemours and Company and those known as Flemion ®, available from Asahi Glass Company, Ltd.

In a preformed diaphragm of fibrillated polyfluorocarbon and perfluorinated ion exchange material, the diaphragm may further include a minor amount of chemically resistant inorganic particulates e.g., particulates selected from the group of zirconium oxide, titanium dioxide, potassium titanate, aluminum oxide, silicon carbide, talc, asbestos, barium sulfate and mixtures thereof. Such diaphragms may contain from about 70 to about 95 percent by weight fibrillated polyfluorocarbon, e.g., polytetrafluoroethylene, from about 1 to about 5 percent by weight of the perfluorinated ion exchange material, i.e., an amount sufficient to provide wettability, and a minor amount of the inorganic particulates, i.e., from about 1 to 25 percent by weight, more preferably from about 5 to 15 percent by weight inorganic particulates, basis total weight of diaphragm.

It may be desirable and even preferable that the preformed diaphragm be asbestos-free. Thus, the polymer metal oxide would be incorporated into an asbestos-free diaphragm, e.g., a diaphragm of fibrillated polyfluorocarbon. Also in those diaphragms including fibrillated polyfluorocarbon, e.g., polytetrafluoroethylene, it may be preferable to use unsintered polytetrafluoroethylene to form the diaphragm. Such unsintered, fibrillated polytetrafluoroethylene may be preferred over fibrillated polytetrafluoroethylene that has been sintered at some stage prior to fibrillation.

The liquid permeability of the diaphragms can be adjusted by utilization of a pore forming material, inorganic gels or combinations thereof. For example, a pore forming material can be included, e.g., codeposited with polyfluorocarbon fibrils and perfluorinated ion exchange material. Such pore forming material is subsequently removable, e.g., by chemical leaching after formation of the diaphragm, by heating to decomposition temperatures of the pore forming material following formation of the diaphragm, or by removal in situ during subsequent operation of the cell via the chemical action of an electrolyte within the cell. Among suitable pore formers in the preparation of the diaphragms are cellulose, rayon, polypropylene, calcium carbonate, starch, polyethylene and nylon. Cellulose, rayon, polypropylene, polyethylene or nylon can be present in any suitable particulate form, e.g., granular or fibrous form. Preferably, the pore forming material is polyethylene or polypropylene and present in fibrous form. Generally, the pore forming material can be added in an amount from about 1 to about 30 percent by weight, more preferably from about 1 to about 20 percent by weight, basis total weight of diaphragm materials.

The diaphragm can also incorporate an inorganic gel. The inorganic gel may be a hydrous metal oxide gel such as magnesium oxide gel, zirconium oxide gel, or titanium oxide gel, a zirconyl phosphate gel, or combinations thereof. Such inorganic gels can serve to reduce the liquid permeability of a diaphragm to a desired level and may also provide ion exchange properties to the diaphragm. The inorganic gel is added to the diaphragm after formation of the diaphragm and preferably after the polymeric metal oxide is incorporated into the diaphragm. For example, after a diaphragm of fibrillated polytetrafluoroethylene and perfluorinated ion exchange material is formed upon a non-planar cathode and the polymeric metallic oxide is incorporated into the diaphragm in accordance with the present invention, an inorganic gel can be added to the diaphragm matrix by filling the matrix with an inorganic gel precursor, i.e., a solution of an inorganic salt, e.g., zirconium oxychloride, titanium oxychloride, or magnesium chloride and thereafter, hydrolyzing the inorganic salt thereby providing a hydrous oxide of the zirconium, titanium or magnesium as the inorganic gel. Magnesium and zirconium inorganic gels can be prepared, e.g., in the manners described in U.S. Pat. Nos. 4,170,537, 4,170,538 and 4,170,539. A zirconyl phosphate gel can be formed by filling the diaphragm matrix with a solution of zirconium oxychloride and then contacting the matrix with a solution of dibasic sodium phosphate to precipitate zirconyl phosphate gel.

Precursors of such hydrous inorganic gels can be deposited in various ways. For example, a solution of the precursor can be brushed or sprayed onto the diaphragm matrix if the solution will penetrate or soak into the porous matrix. Otherwise, the diaphragm matrix can be immersed in the solution, a vacuum drawn to remove the air from the matrix and the vacuum released to draw the solution into the matrix.

Inorganic gels can also be incorporated in the diaphragm in situ during cell operation. For example, an inorganic salt such as magnesium chloride hexachloride or zirconium oxychloride can be added to anolyte, i.e., the brine feed, while the diaphragm is operated in a chlor-alkali cell whereby an inorganic gel can be formed within the diaphragm pores in situ. Mixtures of inorganic salts may be added. Preferably, the inorganic salts may be added to the anolyte immediately after cell startup, i.e., within the first few hours, more preferably, first few minutes, in the period before the hydroxide ions formed at the cathode have begun to migrate substantially through the diaphragm towards the anode.

In operation of chlor-alkali cells containing the diaphragms of this invention, sodium chloride brine feed generally containing from about 290 to 330 grams per liter of sodium chloride will be fed to the anolyte compartment. Such a brine feed can have a quality similar to that typically used in asbestos-type diaphragm cells, i.e., the brine generally can contain about 2 to 3 parts per million alkaline earth metal ion impurities such as calcium and magnesium. In some instances, it may be desirable to use higher quality brine, i.e., brine containing less than about 20 parts per billion alkaline earth metal impurities. Brine treatment methods capable of obtaining the desired quality levels are well known to the skilled in the art.

The present invention is more particularly described by the following example which is intended as illustrative only, since numerous modifications and variations will be apparent to those skilled in the art.

Example 1

Polytetrafluoroethylene powder (TEFLON®60, available from E. I. DuPont deNemours and Co.) was blended with granular sodium chloride in a Brabender mixer at a PTFE:salt weight ratio of 1:10. The resultant clump was removed from the mixer and chopped in a blender to break up the clump. The salt was dissolved in water and polytetrafluoroethylene fibrils of about 20 to 250 microns in diameter and about 1 to 4 millimeters in length were washed, dried and recovered. A mixture including 8.6g of the PTFE fibrils, 0.96g of polypropylene fibers (POLYWEB® available from James Rivers Corporation), 1.25g of an ethanol solution of a perfluorinated ion exchange material having sulfonic acid functional groups, 8.3 weight percent of the ion exchange material (Nafion 601®, available from E. I. DuPont de Nemours and Co.), 4.0 g of RHEOTHIK® 80-11 viscosity modifier and 4.0 g of a non-ionic surfactant (a polyethoxylated aliphatic chloride, i.e., $C_{10-15}(OCH_2CH_2)_9Cl$) was blended in about 225 ml of water.

The slurry was poured over a 3 inch by 3 inch perforated steel plate cathode covered with cellulose filter paper and a 25 inch mercury vacuum was applied to draw the slurry liquids through the cathode. The solids were filtered out as a mat atop the filter paper. The cathode and diaphragm mat were placed in an oven and dried at temperatures between 120° C. to 130° C. for 30 minutes with continued application of the vacuum.

After the diaphragm mat cooled, the diaphragm was impregnated with a clear solution of both partially hydrolyzed silicon alkoxide and zirconium alkoxide. The clear solution was formed by adding 10 g tetraethoxysilane ($Si(OC_2H_5)_4$) to 100 g of 2-propanol. To this mixture was added 0.87g water and four drops concentrated nitric acid, followed by stirring for 30 minutes at 60° C. Then 15g $Zr(OC_3H_7)_4$ was added and the mixture stirred for 5 minutes. Another 50g of 2-propanol was added, followed by the addition of 2.6g water in 16g 2-propanol. Finally, another 25g 2-propanol was added. The diaphragm was impregnated with the solution by dipping in the solution. A vacuum was drawn on the impregnated diaphragm to maintain an air flow through the diaphragm thereby maintaining permeability and the diaphragm was heated for two hours at 120° C. A second coat of the solution was applied via dipping.

The cathode-diaphragm assembly was then placed into a laboratory chlor-alkali cell having a ruthenium oxide/titanium oxide coated titanium mesh anode. The cell was operated with the anode against the surface of the diaphragm. The cell was fed a purified sodium chloride brine (25 weight percent NaCl) containing less than 20 parts per billion total of calcium and magnesium. The cell was operated at about 90° C. with a current density of 133 amperes per square foot (ASF) produced 10.4 weight percent sodium hydroxide (125 gpl) at 2.82 volts and with a cathode current efficiency of 92.6 percent.

Although the present invention has been described with reference to specific details, it is not intended that such details should be regarded as limitations upon the scope of the invention, except as and to the extent they are included in the accompanying claims.

What is claimed is:

1. A liquid permeable diaphragm for an electrolytic cell, the diaphragm comprising a major amount of fibrillated polyfluorocarbon, a minor amount of a perfluorinated ion exchange material and a polymeric metal oxide selected from the group consisting of polytitanic acid, polyzirconic acid, polysilicic acid, polyaluminic acid or mixtures thereof.

2. The diaphragm of claim 1 wherein the perflourinated ion exchange material is a perfluorinated organic polymer having ion exchange functional groups selected from the group consisting of —COOM and —$SO_3M$ where M is hydrogen or an alkali metal ion.

3. The diaphragm of claim 2 wherein the fibrillated polyfluorocarbon comprises polytetrafluoroethylene.

4. The diaphragm of claim 3 wherein the polymeric metal oxide is applied to a predisposed diaphragm mat of the fibrillated polytetrafluoroethylene and the perfluorinated ion exchange material by impregnating the mat with a solution of a metal alkoxide, an alcohol and water, the metal being titanium, aluminum, zirconium, silicon or mixtures thereof and heating the impregnated mat at temperatures and for a period of time sufficient to cure the polymeric metal oxide.

5. In a liquid permeable diaphragm for an electrolytic cell, the improvement wherein the diaphragm further includes a polymeric metal oxide selected from the group consisting of polytitanic acid, polyaluminic acid, polyzirconic acid, polysilicic acid or mixtures thereof.

6. The diaphragm of claim 5 wherein the diaphragm is an asbestos diaphragm.

7. The diaphragm of claim 5 wherein the diaphragm includes asbestos and a polymeric resin.

8. The diaphragm of claim 5 wherein the diaphragm is an asbestos-free diaphragm consisting essentially of polyfluorocarbon.

9. The diaphragm of claim 8 wherein the polyfluorocarbon is polytetrafluoroethylene.

10. A liquid permeable diaphragm for an electrolytic cell consisting essentially of fibrillated polyfluorocarbon and a polymeric metal oxide selected from the group consisting of polytitanic acid, polyaluminic acid, polyzirconic acid, polysilicic acid or mixtures thereof.

11. The diaphragm of claim 10 wherein the polymeric metal oxide is applied to a predisposed mat of the fibrillated polyfluorocarbon by impregnating the mat with a solution of a metal alkoxide, an alcohol and water, the metal being titanium, aluminum, zirconium, silicon, or mixtures thereof and heating the impregnated mat at temperatures and for a period of time sufficient to cure the polymeric metal oxide.

12. The diaphragm of claim 10 wherein the fibrillated polyfluorocarbon is polytetrafluoroethylene.

13. The diaphragm of claim 11 wherein the fibrillated polyfluorocarbon is polytetrafluoroethylene.

* * * * *